United States Patent [19]

Hillary

[11] Patent Number: 4,493,517

[45] Date of Patent: Jan. 15, 1985

[54] ELECTRICAL SOCKET CONNECTOR

[75] Inventor: Brian Hillary, Bognor Regis, England

[73] Assignee: WKR Limited, Bognor Regis, England

[21] Appl. No.: 595,647

[22] Filed: Apr. 2, 1984

Related U.S. Application Data

[63] Continuation of Ser. No. 326,292, Dec. 1, 1981, abandoned.

[30] Foreign Application Priority Data

Dec. 3, 1980 [GB] United Kingdom ..... 80038827

[51] Int. Cl.[3] ..... H01R 13/453

[52] U.S. Cl. ..... 339/42; 339/40

[58] Field of Search ..... 339/40, 41, 42

[56] References Cited

U.S. PATENT DOCUMENTS 3,068,442 1/1961 Kubik et al. ..... 339/36

3,982,804 9/1976 Marechal ..... 339/41

4,176,897 12/1979 Cameron ..... 339/40

FOREIGN PATENT DOCUMENTS 33411 9/1980 European Pat. Off. .

1436611 5/1976 United Kingdom ..... 339/40

1489569 10/1977 United Kingdom ..... 339/40

*Primary Examiner*—Joseph H. McGlynn

*Assistant Examiner*—Paula Austin

*Attorney, Agent, or Firm*—Willian Brinks Olds Hofer Gilson & Lione Ltd.

[57] ABSTRACT

An electrical socket connector is adapted to receive a multiple-pin shrouded plug and has a body containing at least live and neutral sockets and formed with a recess to receive a shroud surrounding the pins of the plug. Moveable shutters are spring biased to close the live and neutral sockets and have cam surface portions extending into the recess to be engaged by the shroud of a plug so as to be moved against the spring bias on insertion of a shrouded plug, thereby to open the shutters.

11 Claims, 5 Drawing Figures

ELECTRICAL SOCKET CONNECTOR

This application is a continuation, of application Ser. No. 06/326,292, filed Dec. 1, 1981 now abandoned.

BACKGROUND OF THE INVENTION

This invention relates to electrical socket connectors for receiving multiple-pin plugs.

It is well-known to have shuttered socket outlets for electrical mains power in which an earth pin on the plug, when inserted in the socket, effects movement of shutters for the live and neutral socket terminals. Such a socket outlet is completely safe with no plug inserted. It is also known to use shrouded plugs with suitably shaped socket outlets. A shrouded plug essentially has a projecting shroud around the plug pins. The shroud may be of a standardised non-circular shape, with the socket having a co-operating recess shaped to receive this shroud. For example the shroud may be basically hexagonal in shape to conform to range CEE22 in Publication 22 of the International Commission on Rules for the Approval of Electrical Equipment. The hexagonal shroud shaping has opposite parallel surfaces comprising a longer side adjacent the live and neutral pins and a shorter side adjacent the earth pin. This use of a non-circular shroud is one way of preventing any possibility of the plug being erroneously inserted into the socket, such as for example putting the earth pin on the plug into the live line socket and the live line pin on the plug into the earth socket. Heretofore outlets to receive shrouded plugs have not had shuttered sockets because there is insufficient room in the plug to employ a conventional shutter operating mechanism operated by the earth pin.

It is an object of the present invention to provide an improved form of socket outlet to receive a shrouded multiple-pin plug but in which the live line and neutral sockets are shuttered.

SUMMARY OF THE INVENTION

According to the present invention, an electrical socket connector to receive a multiple-pin shrouded plug comprises a body portion having at least live and neutral sockets and having a recess to receive a shroud surrounding pins of a plug, and has shutters for the live and neutral sockets comprising a movable shutter member or members with spring biasing means biasing the shutter member or members outwardly towards a portion or portions of said recess, the shutter member or members, in the biased position, extending across the live and neutral sockets and the shutter member or each shutter member having a portion extending into said recess, said portion having a cam surface arranged for engagement by a shroud of a plug so as to be moved against the spring bias on insertion of a shrouded plug thereby to move the shutter member to an open position.

Since the shutters in the above arrangement are actuated by the shroud of a plug, the invention can be applied to socket connectors with no earth socket or with any number of sockets.

The spring biasing means may comprise one or more separate springs or may be integral with the shutter member or members.

The recess may be non-circular to receive a non-circular shroud to prevent any possibility of the plug being inserted erroneously into the socket. Such erroneous insertion can however be prevented in other ways, e.g. by a suitable arrangement of the pins.

Conveniently two shutter members are provided which are movable in opposite directions along a line normal to the axes of the live and neutral sockets and extending through these two sockets so that said portions extend into said recess on opposite sides of the socket assembly. With this arrangement a single spring, e.g. a V-shaped spring such as a wire or a leaf spring, may be arranged between the two shutter members to urge the two members away from one another.

BRIEF DESCRIPTION OF THE DRAWINGS

In the following description reference will be made to the accompanying drawings in which.

DESCRIPTION OF THE PREFERRED EMBODIMENTS

Figure 1:
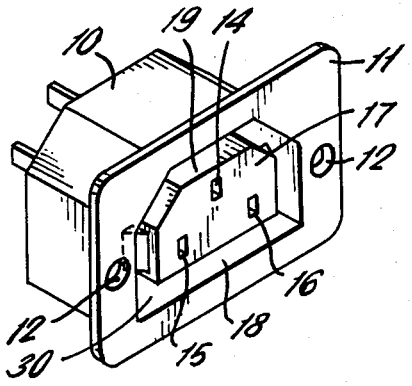
FIG. 1 is a perspective view of a shuttered socket consituting one embodiment of the invention.

Referring to FIG. 1 there is shown an outlet socket for receiving a shrouded three-pin plug. This outlet socket comprises a main body member 10 with a front flange 11 having holes 12 for fixing screws. An earth socket 14 and live line and neutral sockets 15, 16 are provided in a central body portion 17 which is of hexagonal form in cross section normal to the line of insertion of a plug in the socket. The hexagonal form has a longer side 18 adjacent to the live and neutral sockets and parallel to the line through these two sockets. An opposite shorter side 19 lies adjacent the earth socket.

Figure 2:
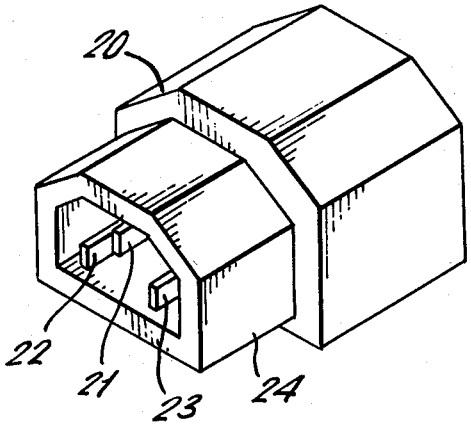
FIG. 2 is a perspective view of a shrouded plug, of known construction, which may be used with the shuttered socket of FIG. 1.

This socket outlet shown in FIG. 1 is adapted to receive a shrouded three-pin plug which is of known form and which is shown in FIG. 2. This plug has a main body member 20 with an earth pin 21 and live line and neutral pins 22, 23. Around these pins and extending forwardly from the body member 20 is a shroud 24 formed of insulating material of substantially uniform thickness.

Figure 3:
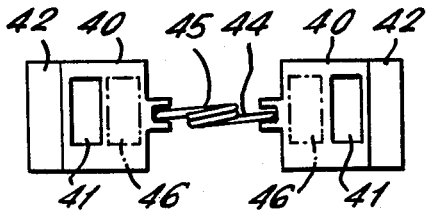
FIG. 3 is a diagram illustrating part of the mechanical construction of the shuttered socket.
Figure 4:
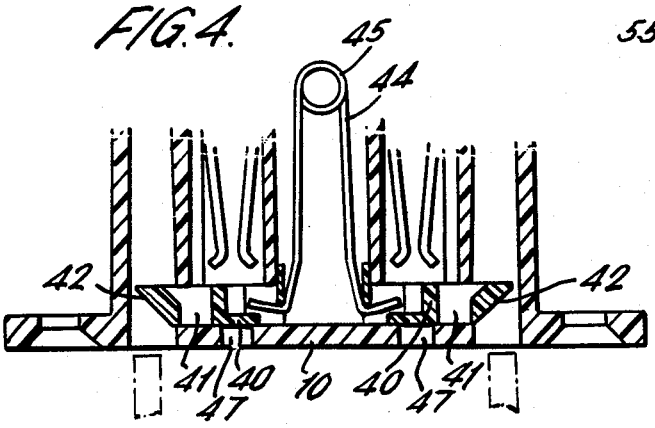
FIG. 4 is a plan view of the elements which are shown in FIG. 3 in elevation.

Reverting now to consideration of the socket, between the aforementioned body member and the flange is a deep groove 30 shaped to receive the shroud on a plug. The body member fits closely inside the shroud with the pins on the plug in the respective socket whilst the flange fits closely around the outside of the shroud. The live line and neutral sockets are shuttered by shutter members, shown to a larger scale in FIGS. 3 and 4. These shutter members each comprise a plate 40 of insulating material having a hole 41, the plate having a portion 42 of tapered thickness along one edge. This tapered portion on each shutter member extends into the aforementioned groove when the shutter member is biased outwardly by spring means. These spring means, in the particular embodiment illustrated, are shown as a V-shaped spring 44 on a pin 45 with the two spring arms biasing the shutter members in opposite directions. The shutter members are movable in the body portion of the cell along a line normal to the axes of the live and neutral sockets and passing through these two sockets.

When a plug is inserted into the outlet, the shroud enters the groove and bears against the tapered portions of the shutter members to force these inwardly against the spring bias. The apertures in the shutter members are forced into position, shown in dotted lines at 46 in FIG. 3, in which they are aligned with the connector pins and sockets of the outlet.

The above-described arrangement provides the known advantages of using a shrouded plug with a co-operating socket. Furthermore it provides the advantages of having a shuttered socket outlet so giving safety when no plug is inserted. Moreover it prevents the use of unshrouded plugs in the socket thereby giving further safety during insertion of a plug in a socket.

Although an arrangement having two separate shutters has been described, it would alternatively be possible to use a single shutter.

Figure 5:
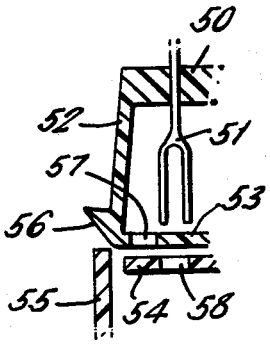
FIG. 5 illustrates how spring means may be forced integrally with a shutter.

Instead of having a separate spring for the shutters, the shutters could be formed of plastics material integrally with the body portion and having a suitably thin portion between the shutter and the main body portion to act as a spring. Such a construction is illustrated in FIG. 5 in which part of the main body is shown at 50 with a contact 51 carried therein. The part 50 has an arm 52 which is flexible and resilient and which is integral with a shutter member 53 movable behind a front plate 54 of the socket. Part of a shroud 55 on the plug is shown in FIG. 5. The shroud bears against a camming surface 56 on the shutter when the plug is inserted in the socket so as to cause the arm 52 to flex and thereby to align an aperture 57 in the shutter member with the contact 51 and with an aperture 58 in the front plate.

Although the above described embodiments have three sockets for three pin plugs, including an earth pin, the invention is equally applicable to sockets and plugs with no earth connection. Further, variations of the socket connector may have three or more sockets and may have shutters for one or more sockets in addition to live and neutral sockets.

What is claimed is:

1. An electrical socket connector to receive a multiple-pin shrouded plug, said socket connector comprising a body portion having at least live and neutral sockets and having a recess adapted to receive a shroud surrounding pins of a plug, and having shutters for the live and neutral sockets comprising a movable shutter member or members with spring biasing means biasing the shutter member or members outwardly towards a portion or portions of said recess, the shutter member or members, in the biased position, extending across the live and neutral sockets and the or each shutter member having a portion extending into said recess, said portion having a cam surface arranged for engagement by a shroud of a plug so as to be moved against the spring bias on insertion of a shrouded plug in a direction oriented at a nonzero angle with respect to the direction of movement of the shrouded plug, thereby to move the shutter member to an open position.

2. An electrical socket connector as claimed in claim 1 wherein the spring biasing means comprise a single spring.

3. An electrical socket connector as claimed in claim 1 wherein the spring biasing means are integral with the shutter member or members.

4. An electrical socket connector as claimed in any of the preceding claims wherein two shutter members are provided movable in opposite directions along a line normal to the axes of the live and neutral sockets and extending through these two sockets so that said portions extend into said recess on opposite sides of the socket assembly.

5. An electrical socket connector as claimed in claim 4 wherein said spring biasing means comprises a single spring arranged between the two shutter members to urge the two members away from one another.

6. An electrical socket connector as claimed in claim 5 wherein said single spring is a V-shaped spring.

7. An electrical socket connector as claimed in claim 1 wherein the recess is non-circular to receive a non-circular shroud.

8. An electrical socket connector as claimed in claim 1 having live, neutral and earth sockets.

9. An electrical socket connector adapted to receive a multiple pin plug, said plug comprising a noncircular shroud surrounding the pins of the plug, said socket connector comprising:

a body portion;

at least a live and neutral socket mounted in the body portion, each socket defining a respective longitudinal axis, said sockets cooperating to define a shutter axis therebetween and normal to the longitudinal axes;

means, included in the body portion, for defining a recess surrounding the live and neutral sockets and shaped to receive the shroud;

first and second shutters, each defining a respective open region, a respective obstructing region, and a respective camming region;

means, included in the body portion, for guiding movement of the first and second shutters in sliding motion along the shutter axis between respective outer positions, in which the camming regions are aligned with respective opposed portions of the recess and the obstructing regions are aligned with respective ones of the sockets to obstruct the sockets, and respective inner positions, in which the camming regions are positioned inwardly of the recess and the open regions are aligned with respective ones of the sockets to expose the sockets; and means for biasing the first and second shutters apart and outwardly along the shutter axis, into the outer positions;

said shroud operating to contact the camming regions when the shroud is inserted into the recess along a direction parallel to the longitudinal axes and to slide the first and second shutters toward one another from the outer positions to the inner positions, thereby automatically exposing the sockets.

10. The connector as claimed in claim 9 wherein the biasing means comprises a single spring interposed between the first and second shutters.

11. The connector as claimed in claim 9 wherein the biasing means is integral with the first and second shutters.

* * * * *